United States Patent [19]

Fernald, Sr.

[11] Patent Number: 5,029,346

[45] Date of Patent: Jul. 9, 1991

[54] TOILET BOWL VENT SYSTEM

[76] Inventor: Robert C. Fernald, Sr., 35 Cross St., Randolph, Mass. 02369

[21] Appl. No.: 523,578

[22] Filed: May 15, 1990

[51] Int. Cl.[5] ..... E03D 9/052

[52] U.S. Cl. ..... 4/213; 4/216; 4/348

[58] Field of Search ..... 4/213, 209 R, 209 FF, 4/216, 210, 217, 218, 347-352, 213

[56] References Cited

U.S. PATENT DOCUMENTS

| | | | |
|---|---|---|---|
| 2,297,935 | 10/1942 | Baither | 4/213 |
| 2,949,615 | 8/1960 | Farrell | 4/216 |
| 3,703,010 | 11/1972 | Russell | 4/216 |
| 3,763,505 | 10/1973 | Zimmerman | 4/213 |
| 3,942,200 | 3/1976 | Pearson | 4/213 |
| 4,168,553 | 9/1979 | Studer | 4/348 |
| 4,232,406 | 11/1980 | Beeghly et al. | 4/213 |
| 4,385,912 | 5/1983 | Parrick et al. | 4/347 X |

FOREIGN PATENT DOCUMENTS

| | | | |
|---|---|---|---|
| 2610340 | 8/1988 | France | 4/347 |
| 8002577 | 11/1980 | PCT Int'l Appl. | 4/347 |
| 1093748 | 12/1967 | United Kingdom | 4/350 |

*Primary Examiner*—Henry J. Recla
*Assistant Examiner*—Casey Jacyna
*Attorney, Agent, or Firm*—Wolf, Greenfield & Sacks

[57] ABSTRACT

A system for venting odors from a toilet having a bowl with a plurality of openings disposed about its rim and a tank to store water with a bowl fill tube interconnected with the openings. A vent is positioned above the level of maximum water storage in the tank. A low pressure region within the vent is established bias air flow through bowl rim openings in the toilet and also through a bowl fill tube in the toilet tank and into the vent. Finally, an exhaust outlet is located at a remote point from the toilet in order to output the air flow from the toilet. To improve venting of air flow between the vent and the fill tube, the tank lid may include a seal positioned between the lid and the tank. The system may also include a valve with dampers that allow air flow to enter the tank during flushing and allow air flow to exit the tank during venting, but that limits air flow when the system is inoperative.

9 Claims, 4 Drawing Sheets

TOILET BOWL VENT SYSTEM

BACKGROUND OF THE INVENTION

1. Field of Invention

This invention relates in general to a toilet bowl venting system and pertains more particularly to a system that biases air flow from the bowl of a toilet through its tank and out to a remote point.

2. Background Discussion

Flush toilets, particularly those located in public rest rooms, have for long been a source of offensive odors. However, these toilets have heretofore contained no internal means for effectively eliminating odors generated in their proximity.

The typical method for dealing with offensive bathroom odors has involved the use of strong smelling chemical disinfectants located in the toilet tank or in the toilet bowl itself. The use of such chemicals is not particularly effective since they generally only serve to mask toilet odors rather than eliminating them, and as concerns over environmental water quality grow, the emptying of such chemicals into the general water disposal system is increasingly undesirable. An alternative method of deodorizing a bathroom area involves the use of either a remotely mounted (such as ceiling mounted) exhaust fan or a remotely mounted chemical air freshener dispenser. The exhaust fan has disadvantages in that it must move large quantities of air from the rest room to the out of-doors resulting not only in a costly loss in heat from the building, but also some actual increase in the dispersion of offensive odors throughout the room owing to the general biasing of air away from the toilet bowl into the wider room environment. Similarly, a remote air freshener serves only to mask room odors with a strong and potentially harmful chemical aerosol rather than eliminating the odors at their source.

OBJECTS OF THE INVENTION

It is, therefore, an object of the present invention to provide a system that eliminates offensive odors from within the toilet bowl proximity itself.

It is a further object of this invention to provide an odor elimination system that utilizes no chemicals or aerosols.

It is a further object of this invention to provide an odor elimination system that may be readily adapted to a variety of existing flush toilets.

It is yet another object of this invention to provide an odor elimination system that allows a minimum of air flow to be exchanged between the toilet bowl and a remote exhaust location.

SUMMARY OF THE INVENTION

To accomplish the foregoing and other objects of this invention, there is provided, in accordance with one aspect thereof, a system for preventing odors from a toilet having a bowl with a plurality of openings disposed about its rim and a tank to store water with a bowl fill tube interconnected with the openings. A means is provided for venting the tank which is located above a level of maximum water storage. There are means for establishing a low-pressure region within this means for venting to bias air flow through openings disposed about the rim of a bowl in the toilet and further through a bowl fill tube in the tank and, subsequently, into the means for venting itself. There is also an exhaust means that is located at a remote point to the output of air flow from the means for venting.

In a preferred embodiment the system for venting may also comprise a means for sealing the lid of a toilet tank to the tank to generally prevent air flow into the tank. The means for venting may also comprise valve means to allow entry of air flow in response to the operation of the means for establishing a low-pressure region and to prevent entry of air flow when the means for establishing is not operating. These valve means may include a means for inleting air flow to the tank in response to suction in the tank created by a toilet flushing action and these valve means may also include first and second damper means located thereon in which the first damper means opens and the second damper means closes in response to air flow biased into the means for venting. Furthermore, in response to air flow biased into the tank due a flushing action, the first damper means may close and the second damper means may open. To reduce air flow while a given damper is closed, each damper may include gasket means. Both these dampers may be generally closed when both a flushing action and operation of the means for establishing are absent.

In another embodiment, the system may include a means for venting that comprises an inlet cap means positioned over an open end and surrounding the sides of the toilet bowl fill tube. This inlet cap means may include sides that extend around the fill tube below the level of maximum water storage with a sufficiently large inside diameter relative to the outside diameter of the fill tube to allow air flow into the inlet cap means. The inlet cap means may also include a passage to allow bowl filling water to enter through the open end of the bowl fill tube. The means for establishing a low-pressure region may also include a motor driven fan means with a means for activating and de-activating itself at predetermined times. This means for establishing may also be located adjacent to the exhaust outlet means.

BRIEF DESCRIPTION OF THE DRAWING

Other objects, features and advantages will occur to those skilled in the art from the following description of the preferred embodiments and the accompanying drawings in which.

DETAILED DESCRIPTION OF THE PREFERRED EMBODIMENT

Figure 1:
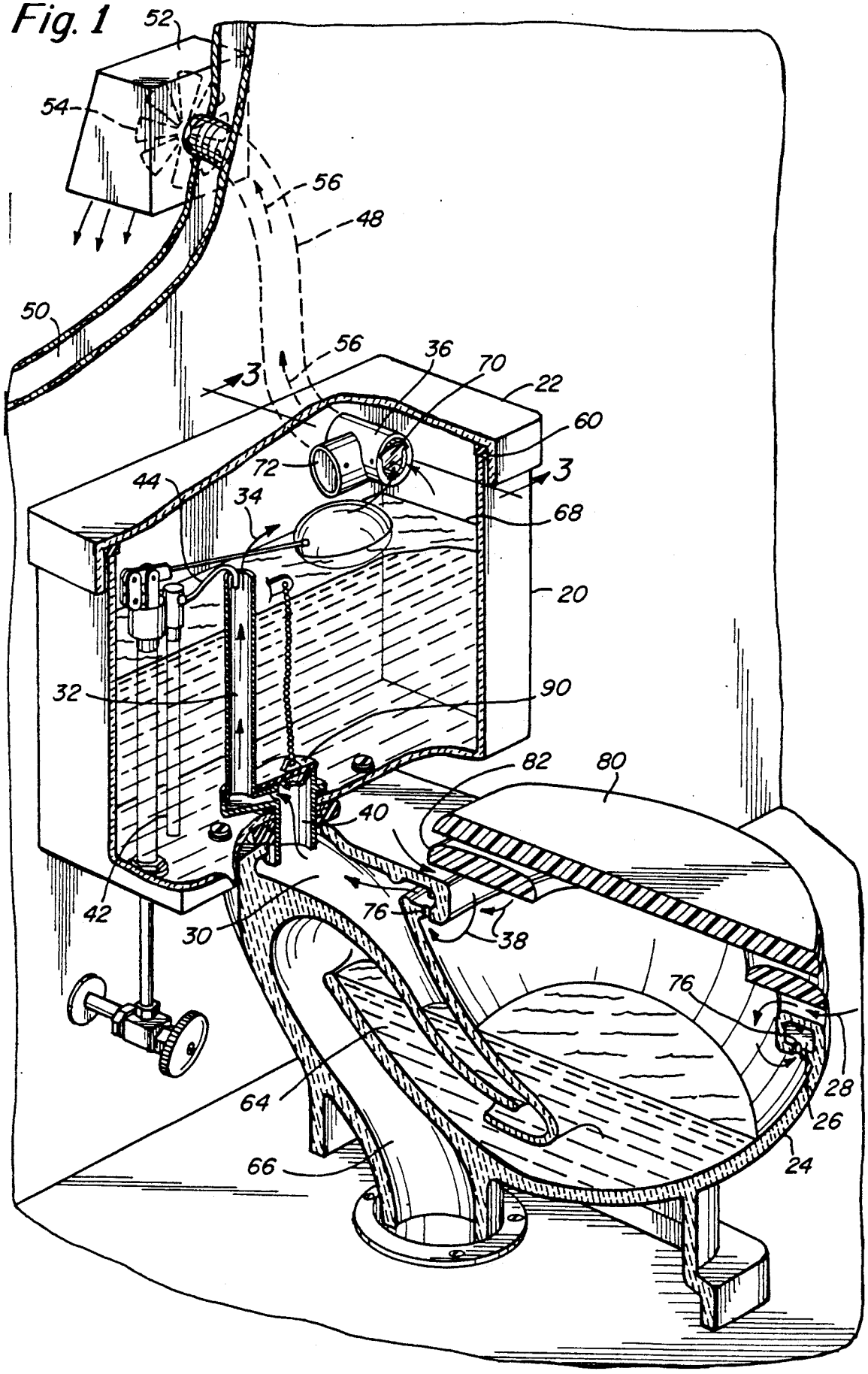
FIG. 1 is a cutaway view of a toilet bowl vent system according to this invention.

A system for removing odors from inside the bowl of a flush toilet is shown in FIG. 1. The toilet generally includes a bowl 24, a tank 20, a lid 22 to the tank, a tank filling tube 42, and a bowl fill/tank overflow tube 32. The toilet is flushed by the action of a pivoting flush stopper 90 positioned over the flush conduit 40. When the flush stopper is removed from the flush conduit, water in the tank, normally at a level 68, descends by force of gravity down a main guideway 30 into the base of the toilet bowl. As the water enters the bowl, it causes the bowl level to rise and, thus, water, along with any refuse in the bowl, is forced out of the trap 64 and into the drain 66.

The trap 64 is filled following the flushing operation through the bowl fill tube 32 so that it generally contains enough water to prevent back-flow of sewer gases up the drain 66 into the bowl. Flushing is further assisted and the bowl is kept generally clean by a series of openings 76 disposed about the hollow rim 26 of the toilet bowl 24. These openings interconnect with the main flush guideway 30. Thus, these holes are also interconnected with the bowl fill tube 32. This bowl fill tube contains at one end an open hole 31 that allows draining of overflow if the tank water level becomes too high and the end also contains a bowl feeding tube 44 which acts simultaneously with the tank filling tube's 42 operation, thus, allowing the bowl and trap 64 to maintain a certain level of water at all times.

In one embodiment of an odor elimination system according to this invention, the flushed toilet tank lid 22 may be sealed to the tank 20 by a tank sealing gasket 60 disposed around the inner perimeter of the tank lid This results in a relatively air tight compartment within the environs of the tank in which only air routed through the bowl fill tube 32 would be allowed to enter the tank.

A vent 36 is located through the wall of the tank and is interconnected to a hollow vent conduit 48. The hollow vent conduit in this example travels through a wall 50, which may be an outside wall, and then interconnects to an exhaust outlet 52 containing an electrically driven fan 54. The fan rotates in order to create an air flow from the interior of the toilet to the exhaust outlet as depicted by the direction arrows 56. The operation of this fan basically controls the timing of the venting process and may be selected to run by a variety of timed, manual or automatic control switching systems. Since the tank is sealed by the tank sealing gasket 60, the only source of air to compensate the low pressure region created in the tank by the bias of air flow through the inlet valve 36 is the bowl fill tube 32. Since this tube is continuously open for overflow purposes to the flush conduit 40 and, thus, to the connecting guideway 30, which themselves connect to the openings 76 in the bowl rim 26, any air flowing into the tank originates from the outside environment through the plurality of openings 76 in the rim 26 of the bowl. The openings 76 are the only areas capable of delivering air flow because the water in the base of the bowl effectively seals off any air flow through the lower portion of the guideway 30. As such, the motor driven fan 54 through the series of sealed passages creates a low-pressure region in the bowl of the toilet 24. This low pressure region is disposed around the rim of the bowl and causes convection currents as depicted by the air flow arrows 28 to enter through the sides of the seat and, as a result, air flow occurs from both outside and inside of the bowl into the ring of openings 76 around the rim. The effectiveness of this system is that no odiferous air from inside the bowl is biased out of the bowl, but rather, it remains in the bowl until it is removed through the rim. This air is subsequently channeled out through the tank and finally out of the building through the exhaust outlet 52.

Figure 3:
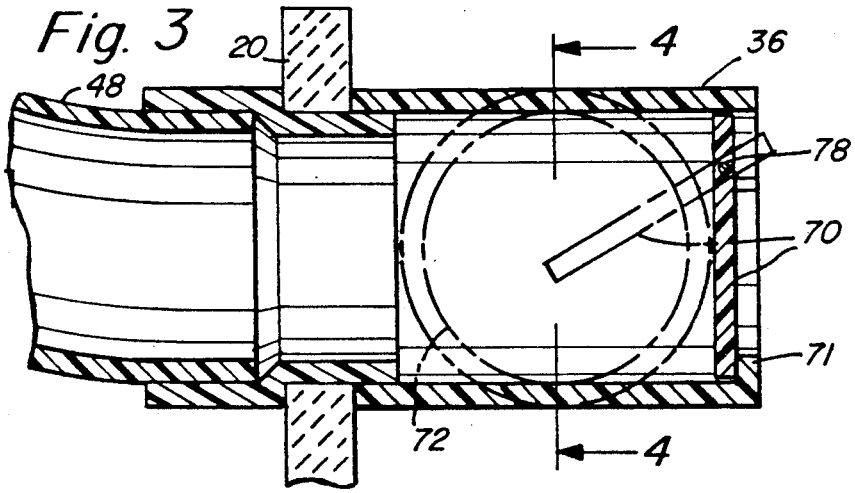
FIG. 3 is a cross-sectional side view of a two-way valve for use with the toilet bowl vent system of FIG. 1.

A cross-sectional side view of the toilet vent two way valve 36 with connecting vent conduit 48 is depicted in FIG. 3. The valve is shown passing through the toilet tank wall 20 and with an intake damper 70 is shown in an open position in phantom. The damper is lightweight to react to a air flow and has a flap-like shape with a pivot pin 78 disposed in the upper part of the figure. An outlet damper 72 is shown in front view in this figure as a circle.

Figure 4:
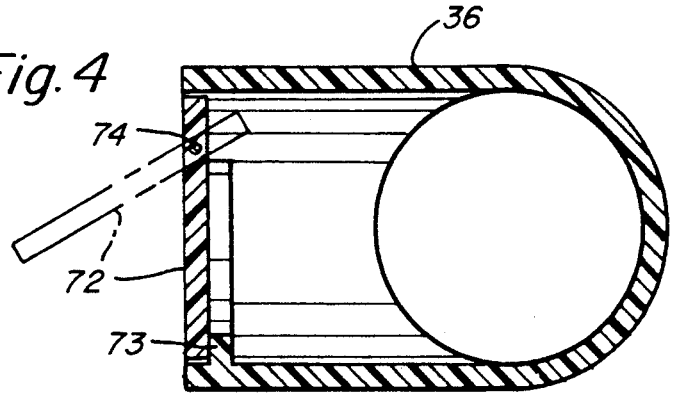
FIG. 4 is a cross-section front view of the valve of FIG. 3.

FIG. 4 discloses a front on view of the valve 36 shown in FIG. 3. In this cross-sectional drawing, the inlet damper 70 is shown as a circle and the outlet damper 72 is shown in an open position at the end of the side facing cylindrical protrusion at the left of the figure. The outlet damper 72 (also lightweight) pivots about a point 74 such that it opens when air flow is biased from the outside into the tank. As such, the damper opens outward as depicted in FIG. 1. When no air flow is present or air flow is biased out of the tank during a venting operation, the damper 72 will rest in a closed position seated firmly against the damper stop 73. A damper sealing gasket material may be is disposed around the stop to prevent undue air flow from leaking through the damper in a closed position. A similar damper stop 71 is shown in FIG. 3 for the inlet damper.

Both dampers 70 and 72 in the valve 36 are closed when neither flushing nor venting occurs. This serves to limit the amount of air exchange between the toilet and the outside environment when the system is not in operation, thus, limiting building climate control losses.

Figure 5:
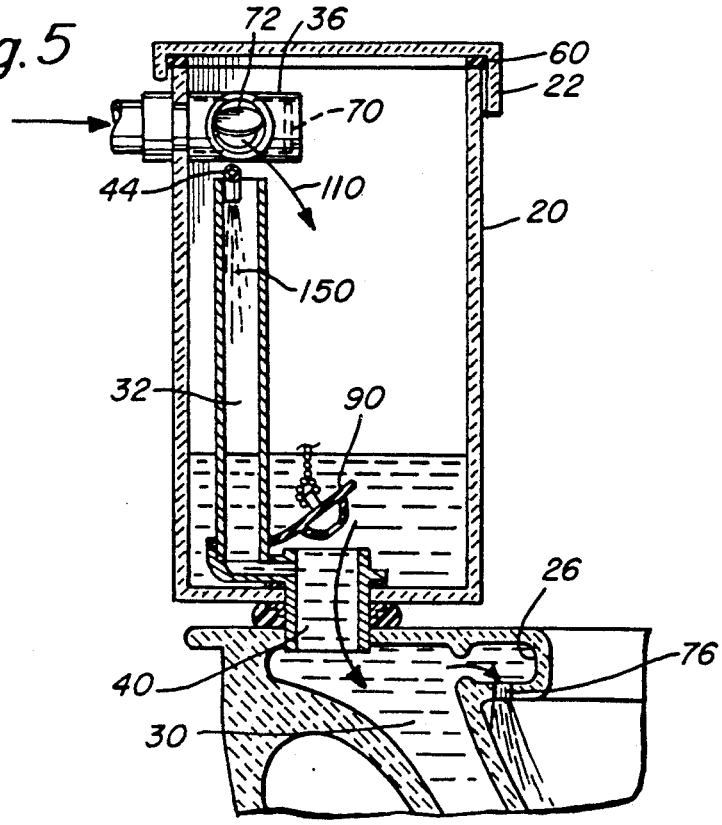
FIG. 5 is a partial side view of the toilet bowl vent system of FIG. 1 depicting the flow of air into the system during a flushing operation.

A flushing operation with the system installed is depicted in FIG. 5. When the flush stopper 90 is pulled upward away from the flush conduit 40, the tank is allowed to drain into the bowl through the main guideway 30 and also through the openings 76 in the hollow bowl rim 26. Since the tank is sealed by the lid gasket 60, the removal of water quickly results in a low pressure region inside the tank. To compensate this low pressure, thus, allowing water to flush unimpeded, the inlet valve 72 of the vent inlet 36 will open as air is biased in an inward direction 110 relative to the tank to equalize outside pressure and tank pressure. At this time, the inlet damper 70 is in a closed position since the net balance of air flow will favor the intake of air rather than the venting of air. Owing to the strength of the suction from the draining tank, inlet air flow occurs despite any continued operation of the fan 54 in the opposite direction. At this time, the bowl fill tube 32 fills with water shown by the flow 150 from the bowl feeding tube 44. Thus, little air is allowed to return up the bowl fill tube to vent. Subsequent to the flush, however, the interconnection between the rim and bowl fill tube is clear of water and normal venting may continue.

Figure 2:
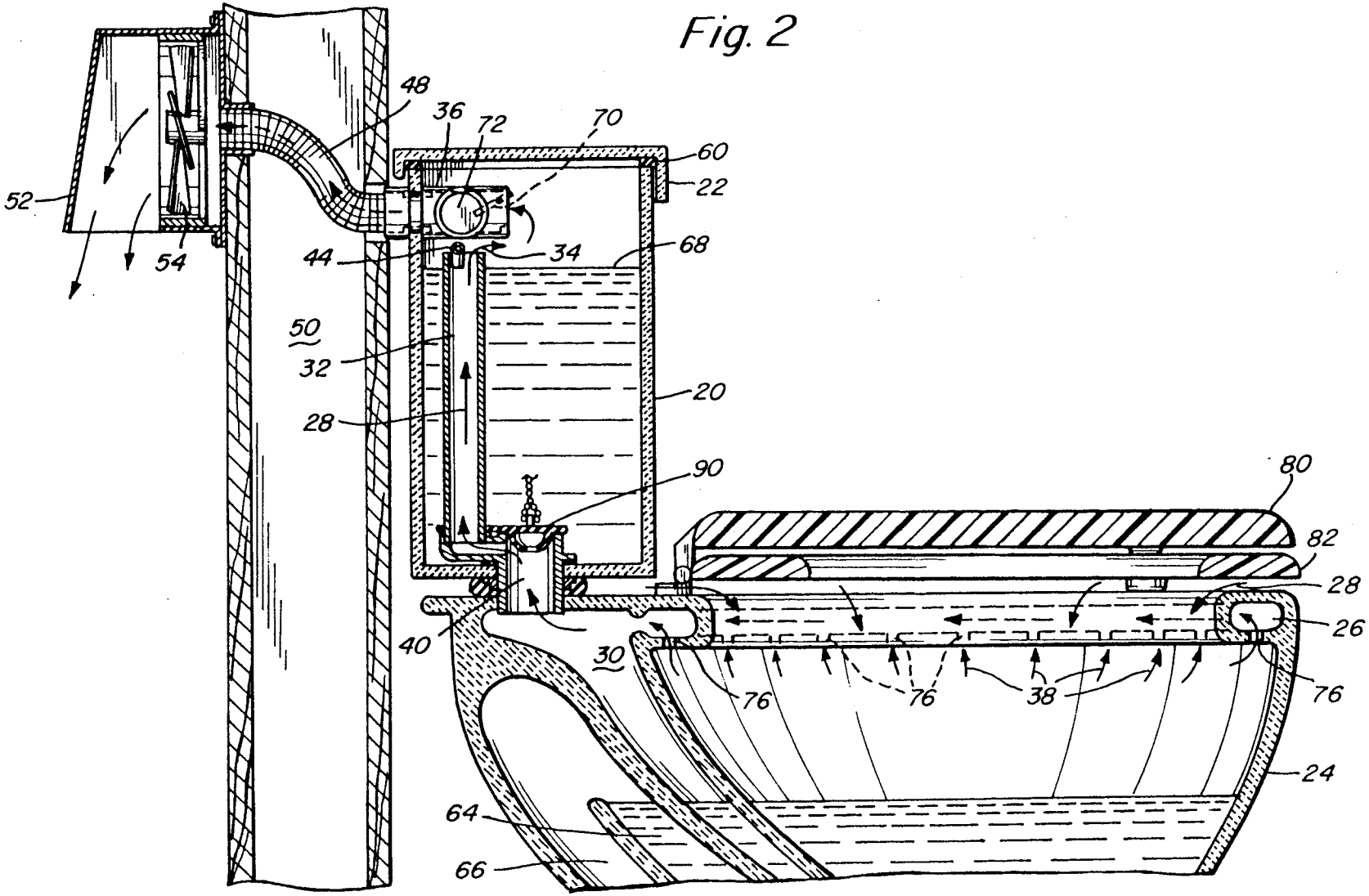
FIG. 2 is a cross-sectional side view of the toilet bowl vent system of FIG. 1.

Again, the venting occurs as depicted in FIG. 1. Note the air flow arrows 28 in both FIGs. 1 and 2 providing venting air flow from the bowl, through conduit 30, tube 32, damper 70 and conduit 48 to the fan 54.

Figure 6:
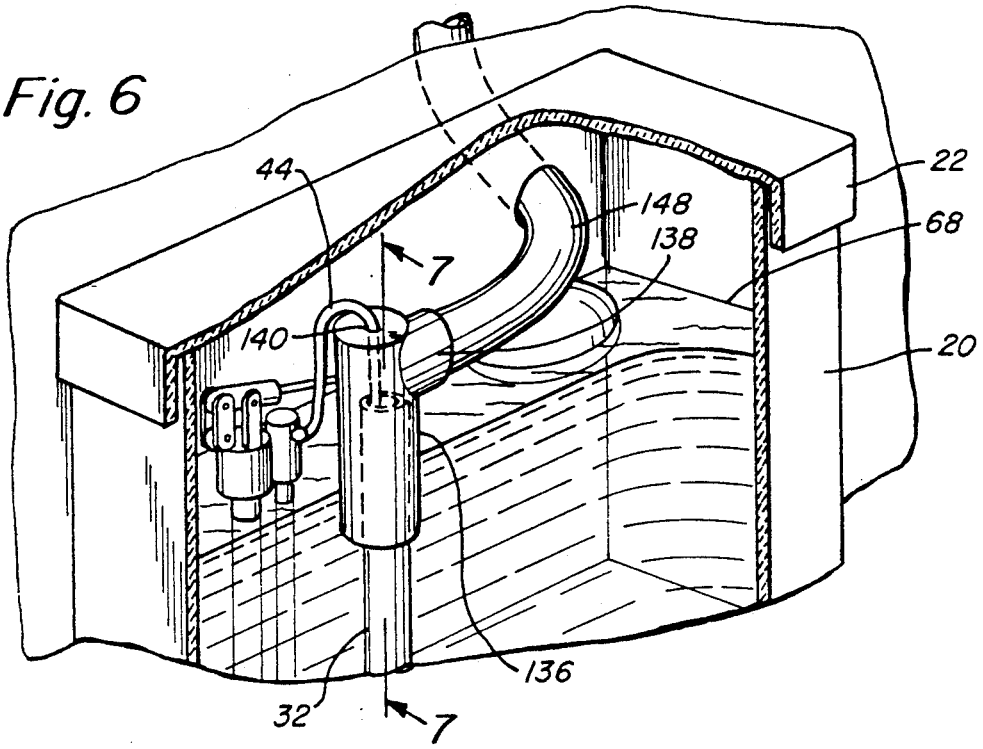
FIG. 6 is a cutaway view depicting an alternative embodiment of a toilet bowl vent system according to this invention.

An alternative embodiment of this vent mechanism is shown in FIG. 6. In this embodiment, the tank lid is not sealed and the lid 22 rests normally with some leakage on the tank 20. The conduit line 148 from the exhaust outlet travels directly through the side of the tank wall above the water line 68 and connects with an inlet cap 136. This inlet cap is generally of a cylindrical shape with a hollow connecting cylinder 138 protruding from the side of the cap near its top. This connecting cylinder is attached to the vent conduit 148. The bowl feeding tube 44 passes through the top of the inlet cap to allow water to flow into the bowl fill tube upon flushing. The area of the cap 140 around the bowl feeding tube 44 is generally tightly fitted to the feeding tube to prevent air flow. The inside diameter of the cap itself is larger than the outside diameter of the bowl fill tube 32 to allow passage of air flow. Because the sides of the cap protrude below the level of water in the tank when it is full 68, the system is generally sealed against air flow from any source other than the bowl fill tube itself. Thus, a positive venting suction from the outlet fan 54 may be achieved to the same extent as with a sealed tank lid. This embodiment, however, unlike the sealed tank lid system requires somewhat less hardware due to the lack of a damper valve system and is also more directly interconnected.

Figure 7:
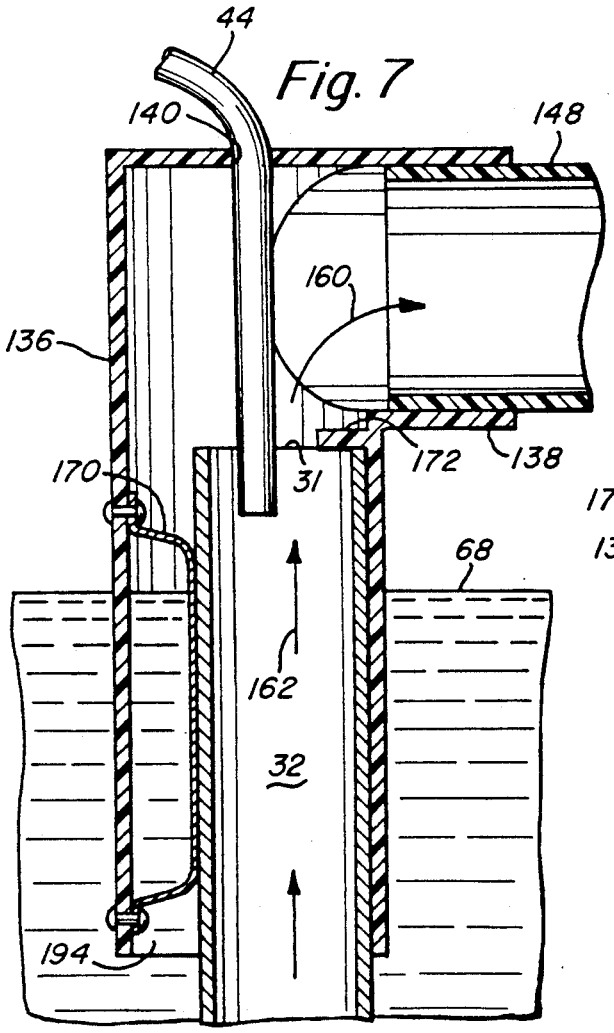
FIG. 7 is a cross sectional side view of a vent cap for use in the toilet bowl vent system of FIG. 6 depicting air flow during a venting operation.

A cross sectional view of the inlet cap 136 is depicted in FIG. 7. In this figure, a venting operation with full tank water 68 is occurring. Air flow 162 rises up the bowl fill tube 32 and passes out into the vent line 148 through the connecting cylinder 138. The cap rests over the bowl open fill tube top 31 with a cap stop 172 contacting this top end of the bowl fill tube to prevent further downward movement of the cap. The cap is also positively held in place against the outer wall of the bowl fill tube by means of a locking spring 170 which forcibly contacts the opposing wall of the bowl fill tube 32. As a result of the difference between the outer diameter of the bowl fill tube 32 and the inner diameter of the cap 136, an opening 194 exists between the walls of the fill tube and the walls of the cap. At the time of venting, as depicted in this figure, the opening is filled with water up to a level 68 below the top of the bowl fill tube, thus, creating a positive seal so that only venting from the bowl fill tube itself may occur. This venting is shown by the air flow arrows 160 and 162.

Figure 8:
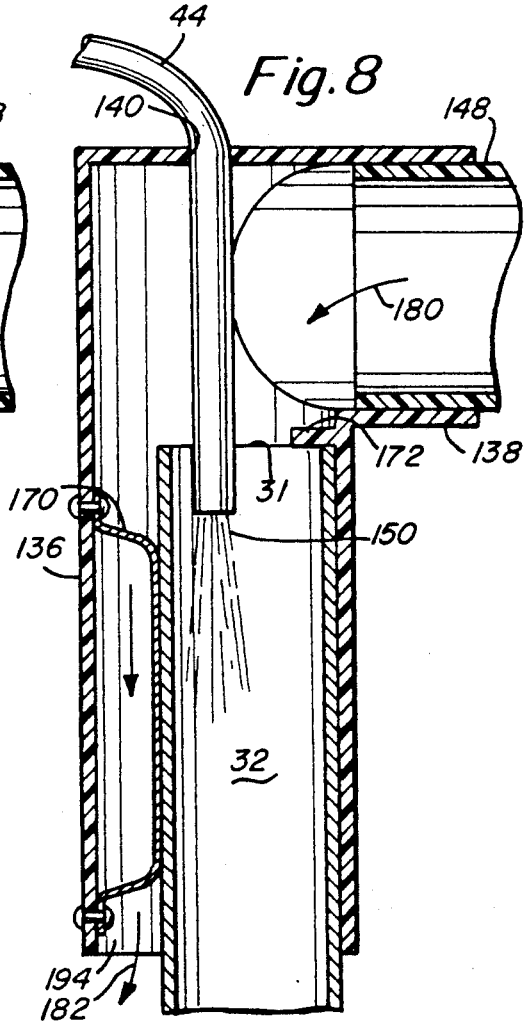
FIG. 8 is a cross-sectional side view of a vent cap for use with the toilet bowl vent system of FIG. 6 depicting air flow into the tank during a flushing operation.

During a flushing operation, as shown in FIG. 8, the water level falls below the end of the opening 194 between the bowl fill tube 32 and cap 136, thus, allowing air flow 180 and 182 to enter from the outside and into the tank through the opening 194. Simultaneously, the feeding tube 44 adds water 150 to the bowl fill tube 32, thus, allowing the bowl to retain a level of water. As the flushing operation completes itself and the tank begins to fill again, air is again vented from the bowl through the fill tube. A positive seal is finally created around the cap and the fill tube by the tank water enabling maximum post flush odor venting.

Having now described the limited number of embodiments of the present invention, it should now be apparent to those skilled in the art that numerous other embodiments and modifications thereof are contemplated as falling within the scope of the present invention as defined by the appended claims.

What is claimed is:

1. A system for venting odors from a toilet without substantially affecting operation of a flush cycle, said system comprising:

a bowl with a plurality of openings disposed about its rim, a tank to store water and being sealed from surrounding atmosphere, and a bowl fill tube interconnecting said tank with the openings;

a valve disposed within said tank for venting said tank and located above a level of maximum water storage, said valve comprising a first damper and a second damper for regulating flow of air into and out of said tank respectively;

air flow means establishing an air flow path between said valve and a location remote from the exterior of said tank; and means for establishing a low pressure region within said valve to bias air flow through said openings disposed about the rim of the bowl in said toilet, through said bowl fill tube in said tank into said valve and through said air flow means, thereby odors are exhausted from said bowl and air is displaced into said tank during a flush cycle of said toilet.

2. The system of claim 1 wherein said valve allows entry of air flow in response to operation of said means for establishing and prevents entry of air flow in response to non-operation of said means for establishing.

3. The system of claim 2 wherein said first damper opens and said second damper closes in response to air flow biased into said valve.

4. The system of claim 3 wherein said first damper closes and said second damper opens in response to air flow biased into said tank due to said flushing action.

5. The system of claim 4 wherein each of said dampers are closed when both said flushing action and operation of said means for establishing are absent.

6. The system of claim 1 in which said means for establishing includes a motor driven fan means.

7. The system of claim 1 wherein said means for establishing is located adjacent to said exhaust outlet means.

8. A system for venting odors from a toilet without substantially affecting operation of a flush cycle, said system comprising; a tank to store water which is sealed from the surrounding atmosphere and a bowl with opening means through which water normally passes in a flushing action, a conduit means for venting said tank and disposed at least partially in said tank, means for interconnecting said conduit means with said opening means so that they are in air communication when not flushing, fan means connected to said conduit means for drawing air from said opening means through said conduit means and directing it to a location remote from the exterior of said toilet, and a valve means in the portion of said conduit means disposed within the tank wherein said valve means includes first and second damper means, said first damper means operable to allow one way flow of air flow into said conduit means in response to operation of said fan means, and said second damper means operable to allow one way flow of air into said tank during flushing, whereby odors are exhausted from said bowl and air is displaced into said tank during a flush cycle of said toilet.

9. The system of claim 8 wherein said venting conduit means includes a conduit coupled through a wall of the toilet at a position above the normal water level in the toilet.

* * * * *